US007971432B2

(12) United States Patent
Troxler

(10) Patent No.: US 7,971,432 B2
(45) Date of Patent: Jul. 5, 2011

(54) FLOW DIFFUSER FOR EXHAUST PIPE

(75) Inventor: Paul J. Troxler, Bellingham, WA (US)

(73) Assignee: PACCAR Inc, Bellevue, WA (US)

( * ) Notice: Subject to any disclaimer, the term of this patent is extended or adjusted under 35 U.S.C. 154(b) by 1023 days.

(21) Appl. No.: 11/827,789

(22) Filed: Jul. 13, 2007

(65) Prior Publication Data

US 2009/0013675 A1 Jan. 15, 2009

(51) Int. Cl.

| | |
|---|---|
| ***F01N 13/00*** | (2010.01) |
| ***F01N 1/16*** | (2006.01) |
| ***F01N 13/08*** | (2010.01) |
| ***F01N 1/14*** | (2006.01) |
| ***F01N 3/02*** | (2006.01) |
| ***F01N 5/04*** | (2006.01) |
| ***F01N 1/00*** | (2006.01) |
| ***B60K 13/04*** | (2006.01) |
| ***B60K 13/02*** | (2006.01) |

(52) U.S. Cl. ..... 60/324; 60/17; 60/319; 180/309; 180/296; 180/89.2; 180/68.3; 181/239; 181/277; 181/228; 181/248; 181/262

(58) Field of Classification Search ..... 181/239, 181/277, 228, 248, 262; 180/309, 89.2, 296, 180/68.3; 60/317, 319

See application file for complete search history.

(56) References Cited

U.S. PATENT DOCUMENTS

| | | | | |
|---|---|---|---|---|
| 773,984 | A | | 11/1904 | Richard |
| 940,031 | A | | 11/1909 | Krotz |
| 1,521,074 | A | | 12/1924 | Carr |
| 1,844,855 | A | * | 2/1932 | Hoyt ..... 181/269 |
| 2,112,534 | A | | 3/1938 | Keen |
| 2,323,891 | A | * | 7/1943 | Blanchard ..... 181/238 |
| 2,652,127 | A | | 9/1953 | Johnston |
| 2,845,775 | A | | 8/1958 | Tyler |
| 2,858,853 | A | | 11/1958 | Lyon |
| 2,896,739 | A | * | 7/1959 | Kuras ..... 181/239 |
| 2,926,743 | A | | 3/1960 | Melchior |
| 3,053,340 | A | | 9/1962 | Kutney |
| 3,066,595 | A | | 12/1962 | Le Quec |
| 3,374,857 | A | | 3/1968 | Hutchins |
| 3,635,308 | A | | 1/1972 | Millman |
| 3,695,388 | A | | 10/1972 | Paxhia |
| 3,865,311 | A | | 2/1975 | Paxhia |
| 3,880,252 | A | * | 4/1975 | Mucka ..... 181/230 |
| 3,952,823 | A | | 4/1976 | Hinderks |

(Continued)

OTHER PUBLICATIONS

Office Action dated Sep. 26, 2008, from U.S. Appl. No. 11/827,708, filed Jul. 13, 2007.

*Primary Examiner* — Thomas E Denion
*Assistant Examiner* — Michael Carton
(74) *Attorney, Agent, or Firm* — Christensen O'Connor Johnson Kindness PLLC

(57) ABSTRACT

A flow diffuser for vehicles of the type having an engine and an exhaust pipe generally includes a substantially tubular body having an outer surface and a first end configured for attachment to an exhaust pipe. The flow diffuser further includes a diffusion portion including at least one channel having a root end located near the outer surface, an exit port, and a channel axis extending between the root end and the exit port, the channel increasing in flow area along the channel axis to reduce exhaust gas velocity.

13 Claims, 15 Drawing Sheets
(10 of 15 Drawing Sheet(s) Filed in Color)

U.S. PATENT DOCUMENTS

| | | | | |
|---|---|---|---|---|
| 3,970,168 | A | 7/1976 | Mucka | |
| 4,060,985 | A | 12/1977 | Fukushima | |
| 4,142,606 | A | 3/1979 | Vanderzanden | |
| 4,233,812 | A | 11/1980 | Leistritz | |
| 4,465,154 | A | 8/1984 | Hinderks | |
| 4,685,292 | A | 8/1987 | Brigham | |
| 4,789,117 | A | 12/1988 | Paterson | |
| 5,058,703 | A | 10/1991 | Ealba | |
| 5,110,560 | A | 5/1992 | Presz, Jr. | |
| 5,166,479 | A | 11/1992 | Gras | |
| D357,665 | S | 4/1995 | Creyts | |
| 5,453,107 | A | 9/1995 | Liu | |
| 5,699,965 | A | 12/1997 | Amelio | |
| 5,761,900 | A | 6/1998 | Presz, Jr. | |
| 6,010,379 | A | 1/2000 | Baumann | |
| 6,220,387 | B1 | 4/2001 | Hoppes | |
| 6,247,523 | B1 | 6/2001 | Shibagaki | |
| 6,267,106 | B1 | 7/2001 | Feucht | |
| 6,385,968 | B1 | 5/2002 | Gustafsson | |
| 6,425,382 | B1 | 7/2002 | Marthaler | |
| 6,615,576 | B2 | 9/2003 | Sheoran | |
| 6,811,756 | B2 | 11/2004 | Atkinson | |
| 6,926,074 | B2 | 8/2005 | Wörner | |
| 7,028,680 | B2 | 4/2006 | Liu | |
| 7,032,578 | B2 | 4/2006 | Liu | |
| 7,036,529 | B2 | 5/2006 | Berggren | |
| 7,316,109 | B2 | 1/2008 | Clerc | |
| 2007/0029132 | A1* | 2/2007 | Feight et al. | 181/239 |
| 2009/0014235 | A1 | 1/2009 | Troxler | |

* cited by examiner

Temperature Profile 50mm from Pipe Wall
Hot Jet Extends to r = 155mm from Pipe Centerline Temperature Profile 100mm from Pipe Wall
Hot Jet Extends to r = 155mm from Pipe Centerline Temperature Profile 150mm from Pipe Wall
Hot Jet Extends to r = 155mm from Pipe Centerline

FLOW DIFFUSER FOR EXHAUST PIPE

BACKGROUND

New, more stringent emission limits for diesel engines necessitate the use of exhaust after-treatment devices, such as diesel particulate filters. Certain after-treatment devices include a regeneration cycle. During the regeneration cycle, the temperature of the exhaust gas plume may rise significantly above acceptable temperatures normally experienced by exhaust systems without such after-treatment devices. As an example, exhaust systems without after-treatment devices typically discharge exhaust gas at a temperature of around 650 degrees Kelvin. An exhaust system having an after-treatment device that includes a regeneration cycle may experience an exhaust gas plume temperature exceeding 900 degrees Kelvin at its center core. Exhaust gas at this high exit temperature creates a potentially hazardous operating environment.

Thus, there exists a need for a flow diffuser for an exhaust pipe for diffusing hot exhaust gas on exit from an exhaust pipe.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a flow diffuser for vehicles of the type having an engine and an exhaust pipe is provided. The flow diffuser generally includes a substantially tubular body having an outer surface and a first end configured for attachment to an exhaust pipe. The flow diffuser further includes a diffusion portion including at least one channel having a root end located near the outer surface, an exit port, and a channel axis extending between the root end and the exit port, the channel increasing in flow area along the channel axis to reduce exhaust gas velocity.

In accordance with another embodiment of the present disclosure, a flow diffuser generally includes a diffusion portion including a plurality of channels, each having a root end located near the outer surface, an exit port, and a channel axis extending between the root end and the exit port, each of the plurality of channels increasing in flow area along the channel axis to reduce exhaust gas velocity. The diffusion portion further includes fluid passageways for the passage of surrounding air between adjacent channels, and each exit port has a shape factor of less than about 0.7.

In accordance with yet another embodiment of the present disclosure, a flow diffuser generally includes a diffusion portion on the outer surface having an elongated slot and at least one substantially serpentine channel having a root end located near the elongated slot, an exit port, and a channel axis extending between the root end and the exit port. The channel increases in flow area along the channel axis to reduce exhaust gas velocity.

DESCRIPTION OF THE DRAWINGS

The patent or application file contains at least one figure executed in color. Copies of this patent or patent application publication with color figures will be provided by the Office upon request and payment of the necessary fee.

The foregoing aspects and many of the attendant advantages of this disclosure will become more readily appreciated by reference to the following detailed description, when taken in conjunction with the accompanying drawings, wherein.

DETAILED DESCRIPTION

Figure 1:
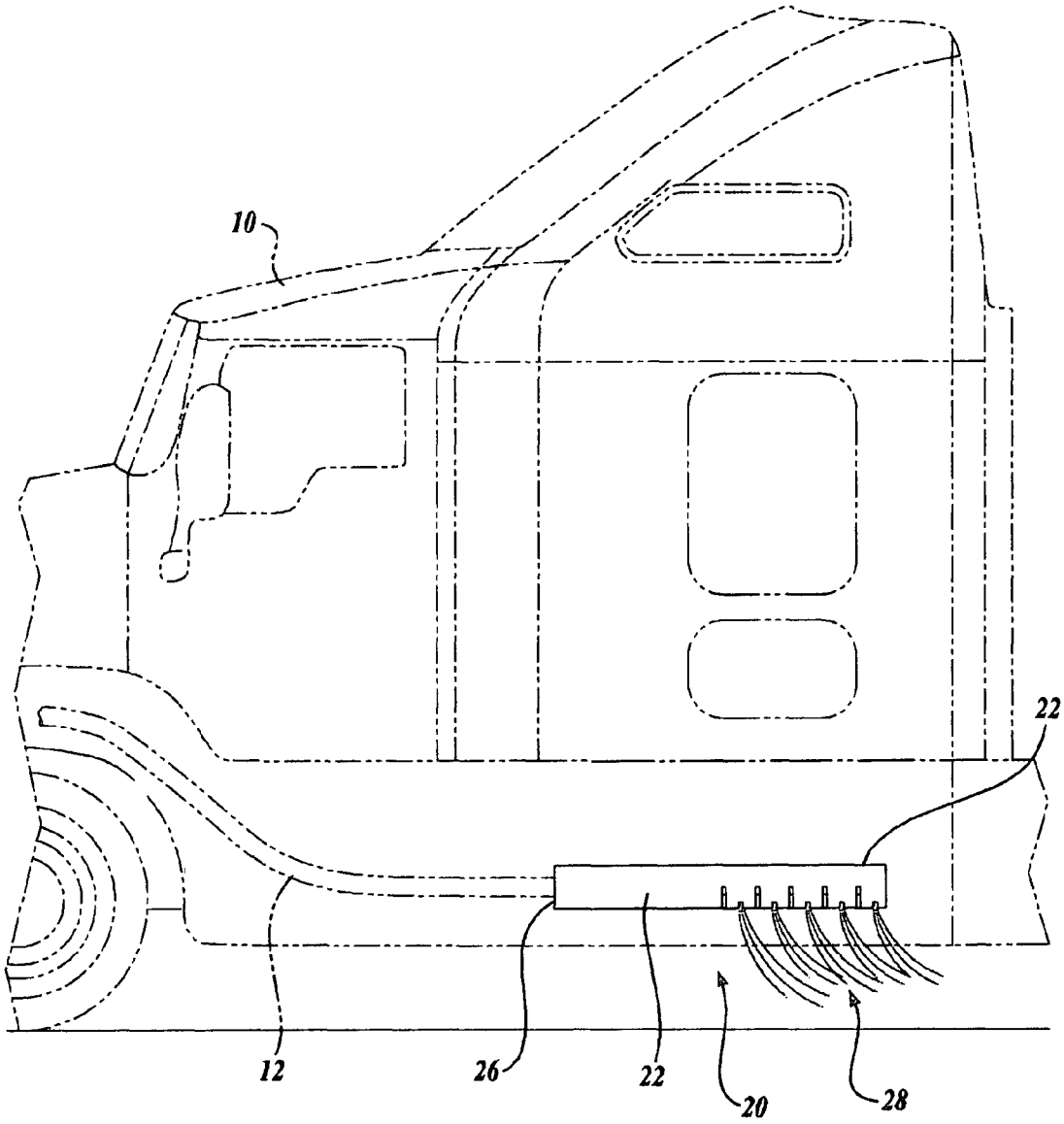
FIG. 1 is a side view of a flow diffuser formed in accordance with one embodiment of the present disclosure, showing the flow diffuser coupled to a vehicle of the type having an engine and an exhaust pipe.
Figure 2:
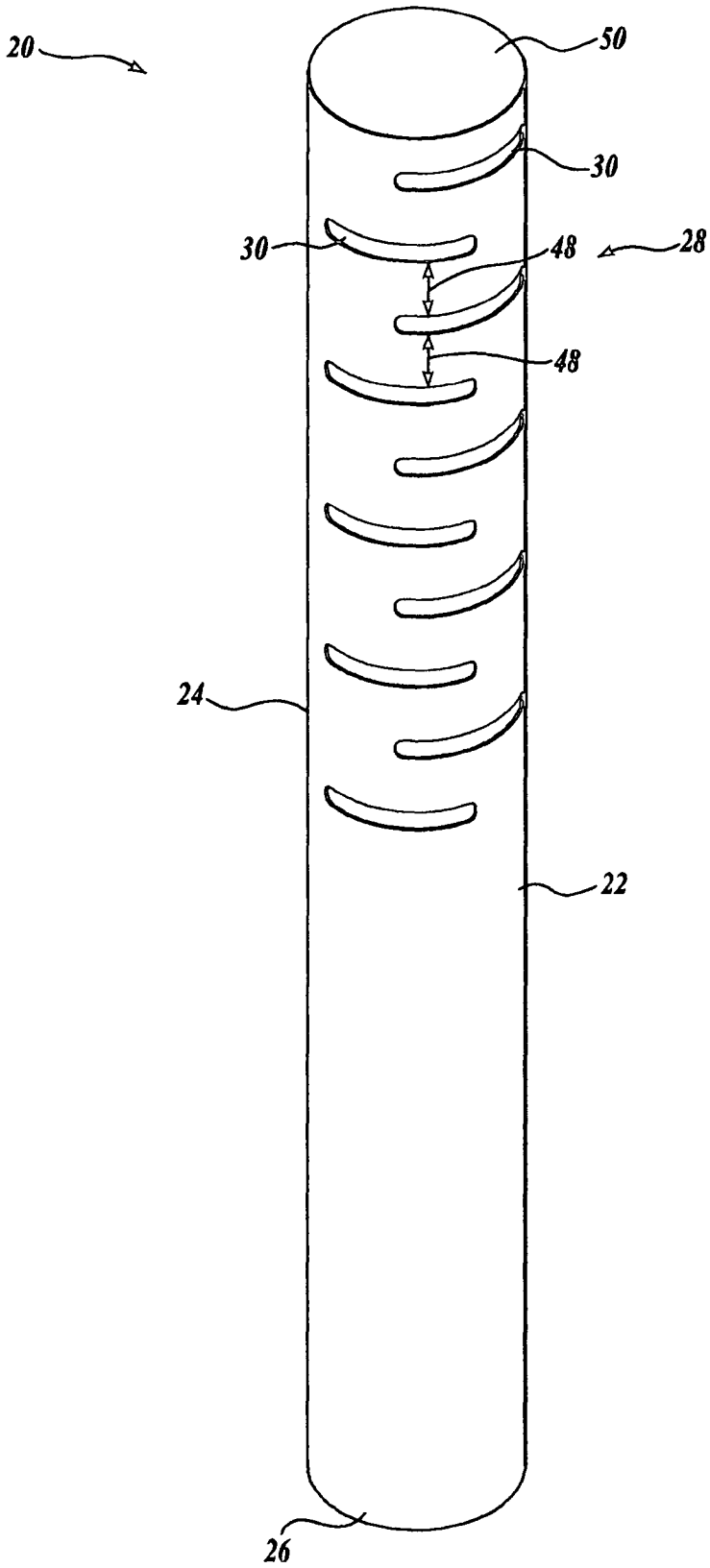
FIG. 2 is a perspective view of the flow diffuser of FIG. 1.

A flow diffuser 20 constructed in accordance with one embodiment of the present disclosure may be best understood by referring to FIGS. 1 and 2. The flow diffuser 20 includes a substantially tubular body 22 having an outer surface 24 and a first end 26 configured for attachment to an exhaust pipe 12. The flow diffuser 20 further includes a diffusion portion 28 on the outer surface 24 having at least one diffusion port 30, wherein the diffusion portion 28 has an optimized flow configuration. During the operation of a vehicle, for example, the vehicle 10 shown in the illustrated embodiment of FIG. 1, exhaust gas travels through an exhaust pipe 12 and is diffused to the surrounding ambient air by the flow diffuser 20.

Flow diffusers 20 of the present disclosure reduce temperature and velocity profiles of hot exhaust gas plumes after exiting an exhaust pipe to reduce the risk of danger associated with hot exhaust pipe discharge. As discussed in greater detail below, specifically, with reference to EXAMPLES 1-3, the flow diffusers described herein reduce exhaust gas velocity, thereby promoting ready mixing and diffusion of hot exhaust gas with cooler surrounding ambient air. In that regard, the combined flow area of the diffusion ports 30 is equal to or greater than the flow area of the inlet or first end 26 to maintain or reduce exhaust gas velocity at the diffusion ports 30 and prevent back pressure within the flow diffuser 20. While fluid mixing with cooler ambient air contributes more significantly to the overall heat dissipation capabilities of the flow diffuser 20, some of the embodiments described herein are also configured to promote heat dissipation (for example, heat loss through the outer surface 24 of the flow diffuser 20) prior to the exhaust gas exiting the flow diffuser 20, as described in greater detail below.

Although illustrated and described in conjunction with under-chassis exhaust pipes, other configurations, such as vertical (i.e., stack) exhaust pipes, are also intended to be within the scope of the present disclosure. It should be appreciated that the first end 26 is an inlet, connectable to the exhaust pipe 12 (see FIG. 1) by any means known to those having ordinary skill in the art, including by an interference fit, welding, or any suitable fastening devices, such as bolts, rivets, or other fasteners.

Referring to FIGS. 1 and 2, a flow diffuser 20 designed and configured in accordance with various aspects of the present disclosure is shown. In the illustrated embodiment of FIGS. 1 and 2, the diffusion ports 30 are shown as elongated slots on the outer surface 24 of the substantially tubular body 22, the elongated slots 30 each having an average length and an average width. The elongated slots have an optimized relationship between slot perimeter and slot area to promote rapid fluid mixing of the hot exhaust gas with the surrounding ambient air. As described in greater detail below with respect to the mixing principles of the flow diffuser 20, an optimized perimeter to flow area relationship provides for a smaller center core of hot exhaust gas in each of the hot exhaust gas streams discharged from the slots 30 (compare temperature section plots in FIGS. 6-9 for the flow diffuser 20 of FIG. 2 and FIGS. 14 and 15 for a standard exhaust pipe 12 having a circular cross-section). Therefore, the elongate slots promote enhanced fluid mixing and temperature distribution for more rapid heat dissipation of the hot exhaust gas streams. Alternate embodiments of the flow diffuser having elongate, channeled diffusion portions are described below with reference to FIGS. 3 and 4.

In the illustrated embodiment of FIG. 2, the perimeter to flow area relationship or shape factor (a measure of compactness of a shape, expressed mathematically as $4\pi$*area/(perimeter)$^2$) of the slots 30 is less than about 0.7. For the most compact shape, the circle, the shape factor is equal to 1.0. As a shape elongates, the shape factor decreases, such that a square cross-section has a shape factor of 0.785. An infinitely long and narrow shape has a shape factor of 0. In another embodiment of the present disclosure, the shape factor of the slots 30 is less than about 0.5. In another embodiment of the present disclosure, the shape factor of the slots 30 is less than about 0.3. In yet another embodiment of the present disclosure, the shape factor of the slots 30 is in the range of about 0.1 to about 0.7. In yet another embodiment of the present disclosure, the shape factor of the slots 30 is in the range of about 0.1 to about 0.5. In yet another embodiment of the present disclosure, the shape factor of the slots 30 is in the range of about 0.1 to about 0.3.

The slots 30 are suitably spaced from one another to define a spacing 48 between adjacent slots 30. In contrast with systems not having adequate spacing between adjacent slots, for example, baffled slot systems, the configurations of the present disclosure provide increased mixing and cooling with cooler ambient air residing in the spacing 48 between the slots 30. As a result of this spacing 48, cooler ambient air is entrained into the exhaust gas streams as they exit from the flow diffuser 20, as described in greater detail below with respect to the mixing principles of the flow diffuser 20. In addition, adequate spacing is required between slots 30, so as to maintain the durability of the outer surface 24 between the slots 30. In that regard, if slots are too closely spaced to one another, the slots are separated by only a thin portion of the outer surface, for example, a thin piece of metal, which creates a durability problem, because the hot exhaust gas may burn through such a thin piece of metal over time.

In the illustrated embodiment, the spacing 48 adjacent each of the slots 30 is at least as great as the average width of the adjacent slots. In other embodiments, the spacing between slots may be at least twice as great as the average width of the adjacent slots. In other embodiments, the spacing between slots may be at least three times the average width of the adjacent slots. In yet other embodiments, the spacing between slots is one to five times the average width of the slots.

Although the flow diffuser 20 is illustrated as having ten equidistantly spaced slots 30 it should be apparent that the number of slots is not intended to be limiting, so long as the combined flow area of the slots 30 is equal to or greater than the flow area at the first end 26, where the flow diffuser 20 is attached to an exhaust pipe 12. As such, a flow diffuser 20 having more or fewer than ten slots 30 is within the scope of the present disclosure. It should be appreciated, however, that the number of slots may be limited by design restrictions and/or the number of slots that can be accommodated along the length of the flow diffuser 20. It should further be appreciated that other diffusion portion configurations are also within the scope of the present disclosure. For example, in the illustrated embodiment, the slots 30 are alternatingly offset by about half the average length of the adjacent slots.

It should be appreciated that the slots 30 may be aligned or offset in any suitable configuration. It should further be appreciated that the slots 30 may be configured to extend transversely, longitudinally, or angled relative to a center longitudinal axis extending through the substantially tubular body 22. In addition, the slots 30 may be configured in straight, curved, and arcuate designs, including, as a nonlimiting example, a substantially serpentine configuration. It should further be appreciated that nonparallel, nonuniform, and nonequidistantly spaced slots 30 are also within the scope of the present disclosure.

As best seen in FIGS. 1 and 2, the slots 30 of the illustrated embodiment are configured to extend on only a portion of the outer surface 24 of the substantially tubular body 22 to direct exhaust gas in one direction from the flow diffuser 20, for example, away from areas of concern, such as the vehicle chassis, wiring, or cab. It should be appreciated, however, that the slots 30 can be configured to extend around the entire outer surface 24 of the substantially tubular body 22, particularly in applications where the direction of exhaust gas flow is not of concern, for example, when the flow diffuser 20 is intended for use with a stack exhaust pipe.

Referring to FIG. 2, the second end 50 of the flow diffuser 20 is capped in the illustrated embodiment to direct the exhaust gas through the diffusion portion 28 of the flow diffuser 20. However, it should be appreciated that other configurations, such as a partially open second end or a vented second end, are within the scope of the present disclosure. Venting of the flow diffuser 20 at the second end 50 may be a desirable configuration to decrease the pressure at the second end 50 of the flow diffuser 20, for example, to prevent back pressure, and/or to diffuse some fluid flow through the second end 50.

The heat transfer and fluid mixing promoted by the flow diffuser 20 of the illustrated embodiment of FIGS. 1 and 2 will now be described in greater detail. When in use, heat dissipation of hot exhaust gas is achieved through the flow diffuser 20 in at least four ways: (1) by heat conduction; (2) by velocity reduction; (3) by optimization of the shape factor of the slots 30; and (4) by optimization of the spacing 48 between adjacent slots 30. As will be described in greater detail below, velocity reduction, shape factor optimization, and spacing optimization, in turn, result in reduction of the center core of the hot exhaust gas streams exiting the flow diffuser 20 to promote enhanced fluid mixing upon exit, thereby resulting in more rapid heat dissipation of the exhaust gas with the surrounding ambient air. As mentioned briefly above, fluid mixing contributes more significantly to the overall heat dissipation of the flow diffuser 20 than heat dissipation by conduction (for example, heat loss through the outer surface 24 of the flow diffuser 20).

First, heat is dissipated from the effective surface area of the flow diffuser 20 to the surrounding ambient air. It should be appreciated that wall thickness of the diffusion portion 28 and the substantially tubular body 22, as well as the thermal resistivity of the material from which the flow diffuser 20 is constructed, contribute to the conductive cooling achieved by the flow diffuser 20, in accordance with the principles of heat transfer. It should further be appreciated that additional cooling of the flow diffuser 20 surface may be achieved by convective cooling. For example, if the vehicle 10 to which the flow diffuser 20 is attached is moving, the fluid flow of the surrounding ambient air over the flow diffuser 20 will further provide cooling to the flow diffuser 20.

Second, because the flow area of the diffusion portion 28 may be greater than the flow area at the inlet or first end 26 of the flow diffuser 20, the velocity of the exhaust gas may decrease as it exits the diffusion portion 28. Decreased exhaust gas velocity allows for a decreased penetration distance of the jet exhaust streams, which further allows for enhanced mixing of the exhaust gas streams with the surrounding ambient air. In addition to the mixing advantages described herein, increased flow area at the diffusion portion 28 also helps decrease back pressure during the vehicle exhaust stroke.

Third and fourth, optimization of the shape factor of the slots 30 and the spacing 48 between adjacent slots 30 also promote increased mixing at the slots 30. With regard to the mixing effects, it should be appreciated that exhaust gas generally has a nonlaminar flow at a high velocity and, comparatively, the surrounding ambient air generally has a substantially quieter flow at a lower velocity. As the exhaust gas exits the separate slots 30, the slots 30 create a plurality of separate exhaust gas streams. Although the velocities of the separate exhaust gas streams decrease with increased flow area at the slots 30, the exhaust gas still exits the slots 30 at a substantially higher velocity than the surrounding ambient air.

When the exhaust gas streams exit the slots 30, the shearing forces between the exhaust gas streams and the surrounding ambient air create a frictional drag at their barriers. This frictional drag creates a series of small vortices along the barriers of the exhaust gas streams, and the circulation of the vortices promotes mixing between the exiting streams and the surrounding ambient air to aid in the diffusion of the exhaust gas. Such mixing aids in significantly decreasing the temperature of the hot exhaust gas and the penetration distance of hot exhaust gas streams discharging from the slots 30. The more ambient air present at the barrier for mixing, the greater the heat diffusion of the exhaust gas. Therefore, the combination of slot 30 elongation for an increased slot perimeter compared to flow area (i.e., shape factor closer to 0) and increased spacing 48 between adjacent slots 30 promotes increased mixing of the exhaust gas with ambient air after exiting the respective slots 30. In addition, if the vehicle 10 to which the flow diffuser 20 is attached is moving, the fluid mixing may be even more enhanced by the introduction of convective mixing principles, described above.

Figure 5:
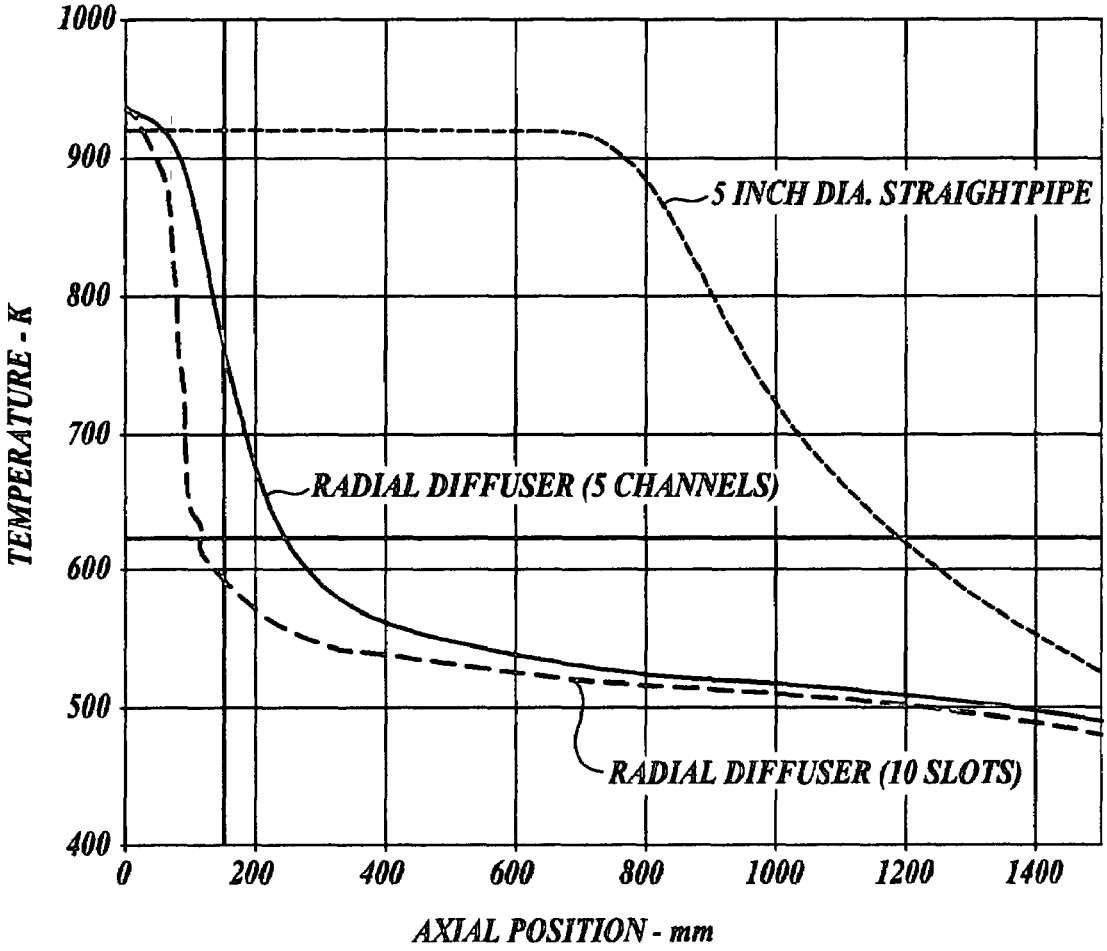
FIG. 5 is a comparison graph plotting exhaust gas exit temperature versus the distance the exhaust gas has traveled from the exit plane or surface for flow diffusers formed in accordance with embodiments of the present disclosure and a standard exhaust pipe not having a flow diffuser.

FIG. 5 is a comparison line graph showing exit temperatures for (1) the flow diffuser of FIG. 2, (2) a second embodiment having a channeled diffusion portion described below with reference to FIG. 3, and (3) a standard five-inch diameter exhaust pipe not having a flow diffuser. All three systems were subjected to simulated diesel particulate filter conditions of over 925 degrees Kelvin and a mass flow rate of about 1 kg/sec. As seen in the comparison graph, the exhaust gas exiting the flow diffuser 20 has immediate heat dissipation from over 925 degrees Kelvin to less than 600 degrees Kelvin within a lateral distance of less than 200 mm from the outer surface of the diffuser 20. Exhaust gas exiting the flow diffuser 120 of the second embodiment, described below, also has near immediate heat dissipation, from over 925 degrees Kelvin to less than 600 degrees Kelvin within a lateral distance of less than 300 mm from the exit plane of the diffusion channels 130. The exhaust gas exiting the standard exhaust pipe, on the other hand, has little to no heat dissipation from over 925 degrees Kelvin to until the exhaust gas reaches a lateral distance of over 700 mm from the exit plane.

Figure 3:
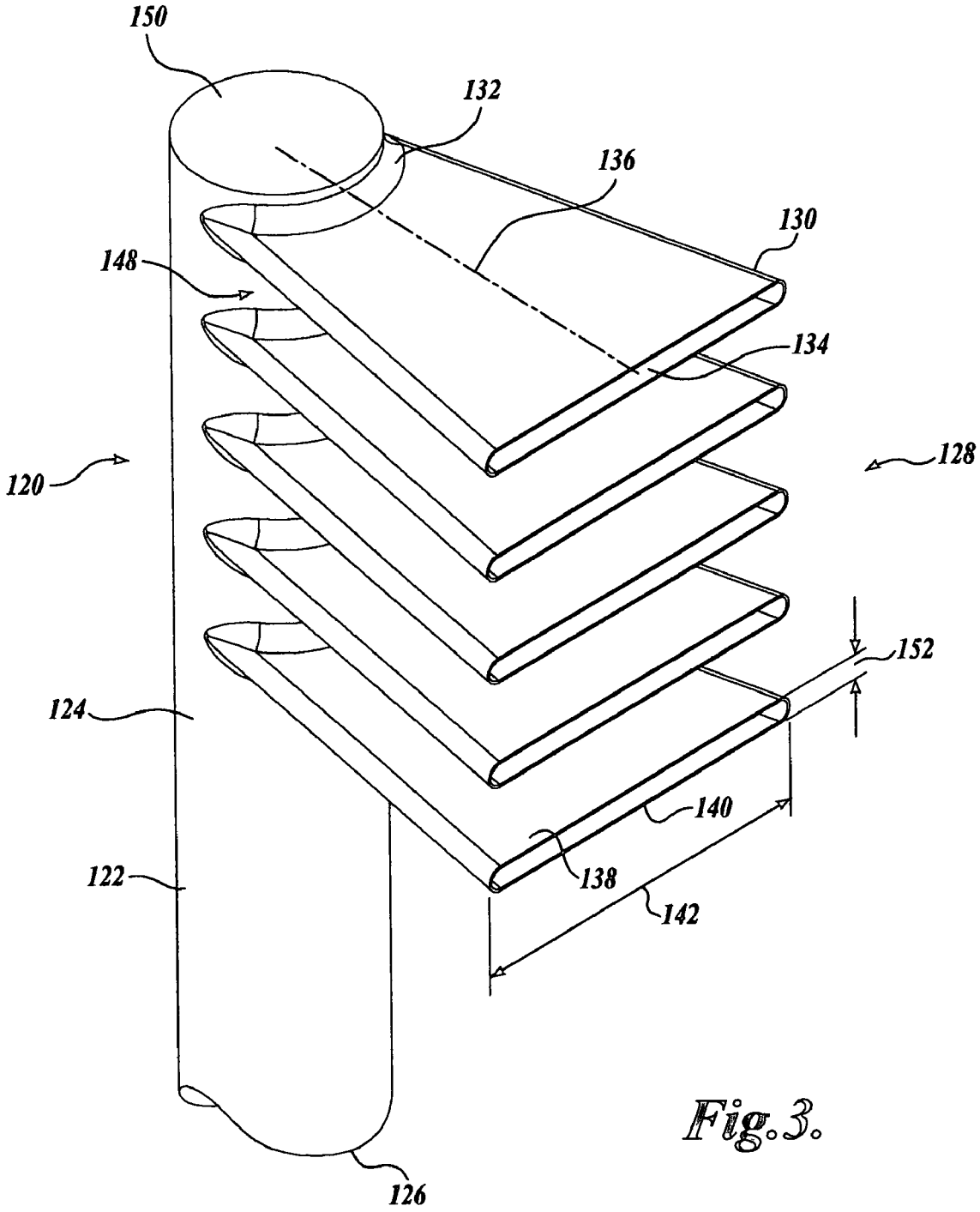
FIGS. 3 and 4 are perspective views of flow diffusers for exhaust pipes formed in accordance with other embodiments of the present disclosure.

Still referring to the comparison graph in FIG. 5, the exhaust gas exiting the standard exhaust pipe eventually reaches about 600 degrees Kelvin after traveling about 1200 mm from the exit plane, over six times further than the dissipated exhaust gas from the flow diffuser 20 of the illustrated embodiment of FIGS. 1 and 2, and over four times further than the dissipated exhaust gas from the flow diffuser 120 of the illustrated embodiment of FIG. 3. Once the exhaust gas exiting the standard exhaust pipe begins to dissipate, it also has more gradual heat dissipation after traveling 700 mm from the exit plane than the exhaust gas exiting the flow diffuser 20 has immediately upon reaching the exit plane, as seen by comparing the cooling slopes of the three lines. For further comparative analysis, see EXAMPLES 1-3 and FIGS. 6-15, described below.

Now returning to FIGS. 3 and 4, flow diffusers formed in accordance with other embodiments of the present disclosure will be described in greater detail. The flow diffusers are substantially identical in materials and operation as the previously described embodiment, except for differences regarding the diffusion portions of the flow diffusers, which will be described in greater detail below.

Figure 4:
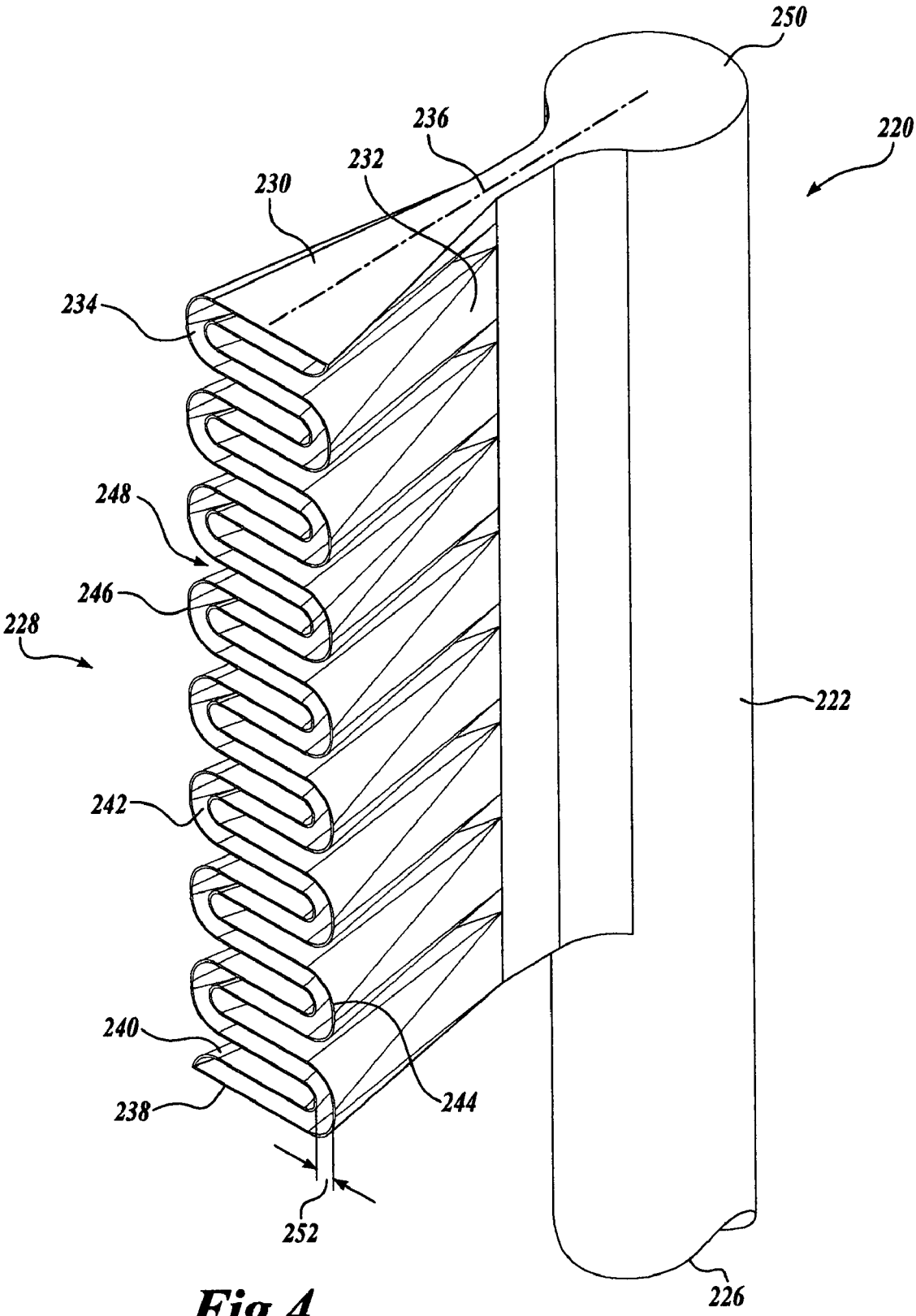

For clarity in the ensuing descriptions, numeral references of like elements of the flow diffuser 20 are similar, but are in the 100 and 200 series, respectively, for the illustrated embodiments of FIGS. 3 and 4.

Referring to FIG. 3, a flow diffuser 120 designed and configured in accordance with various aspects of the present disclosure is shown. In the illustrated embodiment of FIG. 3, the diffusion ports 130 are shown as channels, as opposed to slots 30 in the illustrated embodiment of FIGS. 1 and 2. The channels 130 have root ends 132 located near the outer surface 124 of the substantially tubular body 122, exit ports 134, and channel axes 136 extending between the root ends 132 and the exit ports 134. As mentioned above, with reference to the previously described embodiment, the fluid flow area from the diffusion ports 130 of this second embodiment is equal to or greater than the flow area at the inlet or first end 126 of the substantially tubular body 122 to maintain or reduce exhaust gas velocity at the diffusion ports 130 and to prevent back pressure within the flow diffuser 120.

Similar to the previously described embodiment, the flow diffuser 120 of the second embodiment also provides exhaust gas diffusion; however, the flow diffuser 120 of the second embodiment has exit ports 134 that are laterally spaced from the outer surface 124 of the tubular body 122. In this regard, the channels 130 of the flow diffuser 120 can be used to laterally reposition the exhaust exit ports 134 at a specific distance from the outer surface 124 of the tubular body 122 to more effectively direct hot exhaust gas away from areas of concern, such as the vehicle chassis, wiring, or cab.

In the illustrated embodiment, the channels 130 preferably increase in fluid flow area along the channel axes 136 to further reduce exhaust gas velocity through the channels 130. In that regard, the channels 130 each have first and second parallel surfaces 138 and 140 and a channel width 142 that increases along the channel axis 136 between the root end 132 and the exit port 134. Because the channel width 142 increases along the channel axis 136, the cross-sectional area of each channel 130 also increases along the same direction to, respectively, increase the fluid flow area of each channel 130 along the channel axis 136.

Similar to the previously described embodiment, the channels 130 of this second embodiment also have an optimized perimeter to flow area relationship, or shape factor, at each exit port 134. Like the previously described embodiment, the exit ports 134 may be designed to have a shape factor of less than about 0.7. In another embodiment, the shape factor at the exit ports 134 is less than about 0.5. In another embodiment, the shape factor at the exit ports 134 is less than about 0.3. In yet another embodiment, the shape factor at the exit ports 134 is in the range of about 0.02 and 0.2.

Also similar to the previously described embodiment, the channels 130 are suitably spaced from one another to define spacings, shown as passageways 148 between adjacent channels 130. The passageways 148 of the illustrated embodiment provide increased conductive and convective cooling of exhaust gas within the channels 130 with cooler ambient air residing in or passing through the passageways 148. As a result of these passageways 148, cooler ambient air may provide some convective cooling to the channels 130. This cooler ambient air residing in the passageways 148 also is entrained into the exhaust gas streams exiting from the exit ports 134. In the illustrated embodiment, the spacing between channels 130 is at least as great as the average width 152 of the adjacent channels 130. Like the previously described embodiments, the spacing between channels 130 may be at least twice or three times as great as the average width 152 of the adjacent channels 130, or anywhere from one to five times the spacing between channels 130.

Like the previously described embodiment, it should be apparent that the number and spacing of channels 130 in the flow diffuser 120 is not intended to be limiting. In that regard, a flow diffuser 120 having more or fewer than the five channels 130 shown in FIG. 3 is within the scope of the present disclosure. It should further be appreciated that other channel 130 configurations are also within the scope of the present disclosure. As a nonlimiting example, the configuration of the channels 130 may curve along the width 152 or the channel axis 136. It should further be appreciated that nonparallel, nonuniform, and nonequidistantly spaced channels 130 are also within the scope of the present disclosure.

The heat transfer and fluid mixing promoted by the flow diffuser 120 of the illustrated embodiment of FIG. 3 will now be described in greater detail. Like the previously described embodiment, heat dissipation of the hot exhaust gas is achieved through heat conduction, velocity reduction, optimization of the shape factor of the channel 130 flow area, and optimization of the spacing or passageways 148 between adjacent channels 130.

In addition to the heat transfer and fluid mixing described above with reference to the previous embodiment, the illustrated embodiment of FIG. 3 provides for additional conductive heat transfer over the previously described embodiment. In that regard, heat is dissipated from the effective surface area of the flow diffuser 120 to the surrounding ambient air. Channels 130 having increasing flow area along the channel axis 136 also have an increasing effective surface area surrounding the flow area and, correspondingly, increased heat conduction to the surrounding ambient air. In addition to increasing the effective surface area surrounding the flow area, the passageways 148 between the channels 130 allow ambient air to pass around the entirety of the effective surface area of the channels 130 to increase conductive cooling. As mentioned above, such cooling may be increased by convection, for example, when the vehicle is in motion.

Turning now to FIG. 4, a flow diffuser 220 designed and configured in accordance with other aspects of the present disclosure is shown. In that regard, the flow diffuser 220 of the illustrated embodiment of FIG. 4 includes a substantially serpentine diffusion port 230. Similar to the flow diffuser 120 described above, the diffusion port 230 includes a channel that increases in cross-sectional area along the channel axis 236 to reduce exhaust gas flow temperature and velocity. In accordance with a serpentine configuration, the channel 230 has first and second undulating surfaces 238 and 240 that are spaced from one another at a channel width 252 along the channel axis 236. The first and second undulating surfaces 238 and 240 thus define a substantially serpentine channel 242 along the channel axis 236, best seen at the exit port 234. In that regard, the first and second undulating surfaces 238 and 240 include a repeating series of uniform peaks 244 and troughs 246 that are substantially U-shaped in cross-section.

Along the channel axis 236, the flow area of the serpentine channel 242 increases. Specifically, the height of the peaks 244 and troughs 246 increases along the channel axis from the root end 232 of the serpentine channel 242 to the exit port 234 of the serpentine channel 242. In the illustrated embodiment of FIG. 4, the root end 232 of the serpentine channel 242 is located near an elongated slot on the outer surface 224 of the substantially tubular body 222 of the flow diffuser 220. As the peaks 244 and troughs 246 of the serpentine channel 242 increase, exterior passageways 248 are formed for the passage of surrounding ambient air at the exterior surfaces of the channel 230. As the height of the peaks 244 and troughs 246 increases along the channel axis 236 from the root end 232 to the exit port 234, the depth of the exterior spacings or passageways 248 likewise increases.

In the illustrated embodiment, the passageways 248 between the peaks 244 and troughs 246 have an average width at least as great as the average width 252 of the channel 230 at the exit port 234. In other embodiments, the passageways 248 between the peaks 244 and troughs 246 have an average width at least twice, three times, or anywhere between one and five times as great as the average width 252 of the adjacent channels 230 at their exit port 234. Moreover, in accordance with embodiments of the present disclosure, the exit port 234 of the serpentine channel has a shape factor of less than about 0.7, less than about 0.5, less than about 0.3, or in the range of about 0.02 to about 0.2.

It should be appreciated that in other embodiments in accordance with the present disclosure, the serpentine channel may include nonuniform peaks and troughs or a varying channel width 252 between first and second undulating surfaces 238 and 240. Moreover, the serpentine pattern may include a repeating pattern of another configuration than the U-shaped design illustrated herein. As nonlimiting examples, the pattern may include V-shaped peaks and troughs, as well as box-shaped peaks and troughs.

Like the previously described embodiments, heat dissipation of the hot exhaust gas is achieved through heat conduction, velocity reduction, optimization of the shape factor of the channel 230 flow area, and optimization of the passageways 248 between adjacent peaks 244 and troughs 246. The peaks 244 and troughs 246 increase along the channel axis 236 from the root end 232 to the exit port 234 to provide increased effective surface area along the channel axis 236 for enhanced conductive and/or convective cooling. As mentioned above, the depths of the exterior spacings or passageways 248 likewise increase along the channel axis 236 to increase conductive and convective heat transfer with the surrounding ambient air. In addition, the velocity of the exhaust gas decreases as the flow area of the channel 230 increases to promote enhanced fluid mixing with the surrounding ambient air.

The heat transfer and fluid mixing promoted by the flow diffuser embodiments described herein may be further understood by referring to the exemplary temperature section plots of flow diffusers under simulated use conditions, as described below in EXAMPLES 1 and 2 and as seen in FIGS. 6-13, modeling mass flow, inlet temperature, and exit port temperature of a diesel particulate filter undergoing regeneration. For further comparative analysis, exit temperature section plots for a standard five-inch, straight exhaust pipe under the same exhaust gas exit conditions are described below in EXAMPLE 3 and seen in FIGS. 14 and 15.

Figure 12:
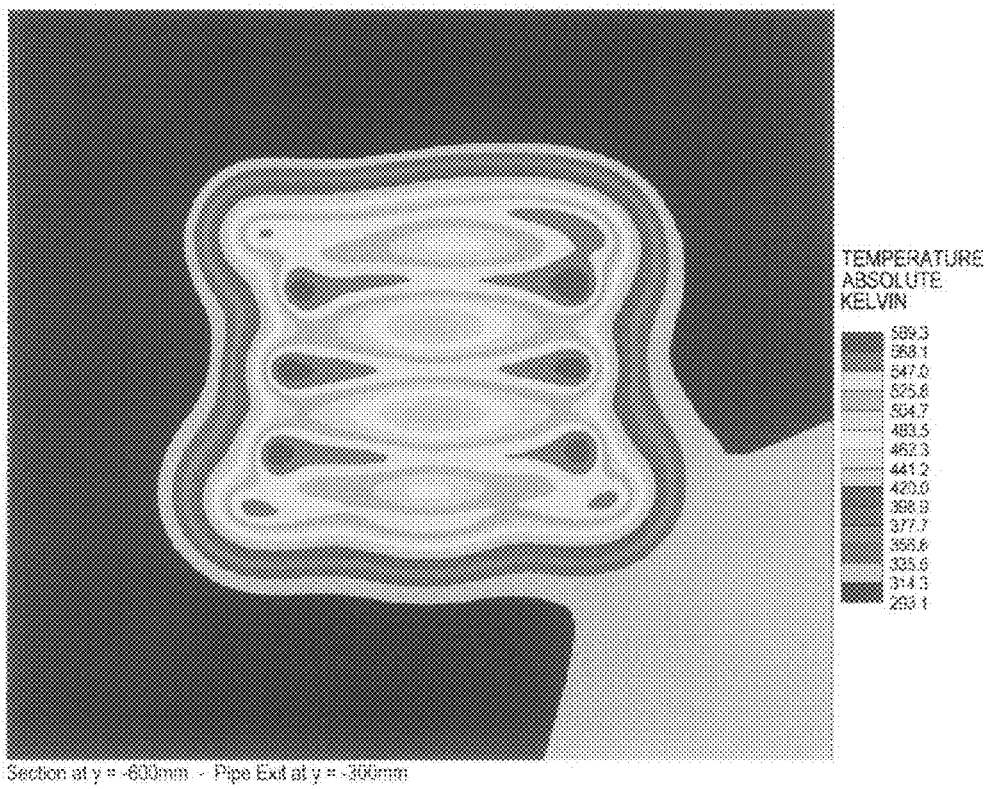
Figure 13:
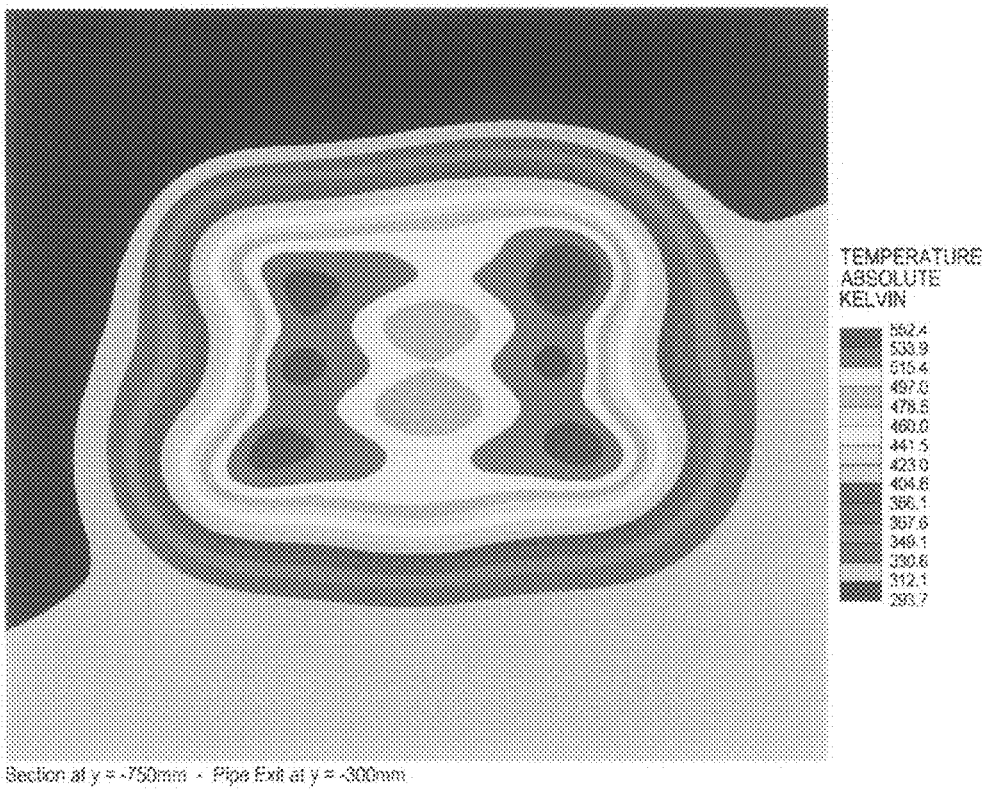
Figure 14:
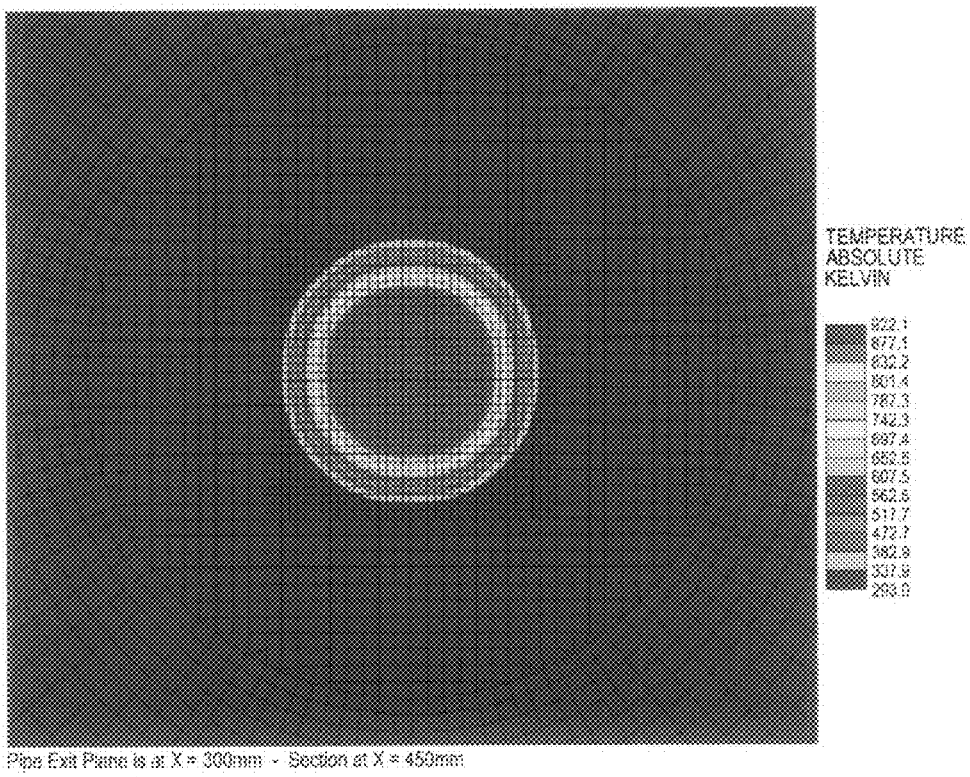
Fig. 14. (PRIOR ART)
FIGS. 14 and 15 are exit temperature section plots for a standard exhaust pipe not having a flow diffuser.
Figure 15:
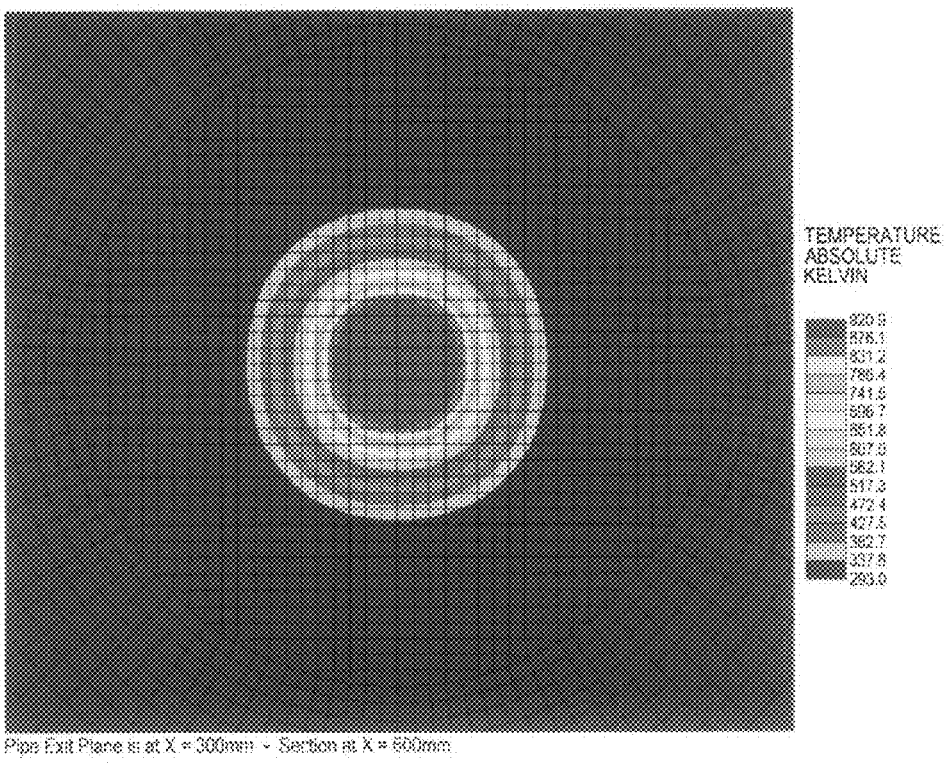
Fig. 15. (PRIOR ART)

As best seen by comparing the temperature section plots of FIGS. 6-13 for the flow diffusers embodiments 20 and 120 and FIGS. 14 and 15 for the standard exhaust pipe, the mixing effects of the flow diffusers formed in accordance with embodiments of the present disclosure are improved over the mixing effects of a standard exhaust pipe as a result of the following: the combination of decreased exhaust stream velocity, resulting in improved mixing at the barrier; increased slot perimeter compared to flow area (i.e., a shape factor approaching 0), resulting in a reduced core in the exhaust gas streams and an increased barrier for the flow area for enhanced mixing; and a greater spacing area between adjacent exit ports, resulting in a greater amount of ambient air at the barrier of the exhaust gas streams for enhanced mixing with ambient air.

EXAMPLE 1

Exhaust Temperature Section Plots for Flow Diffuser

Figure 6:
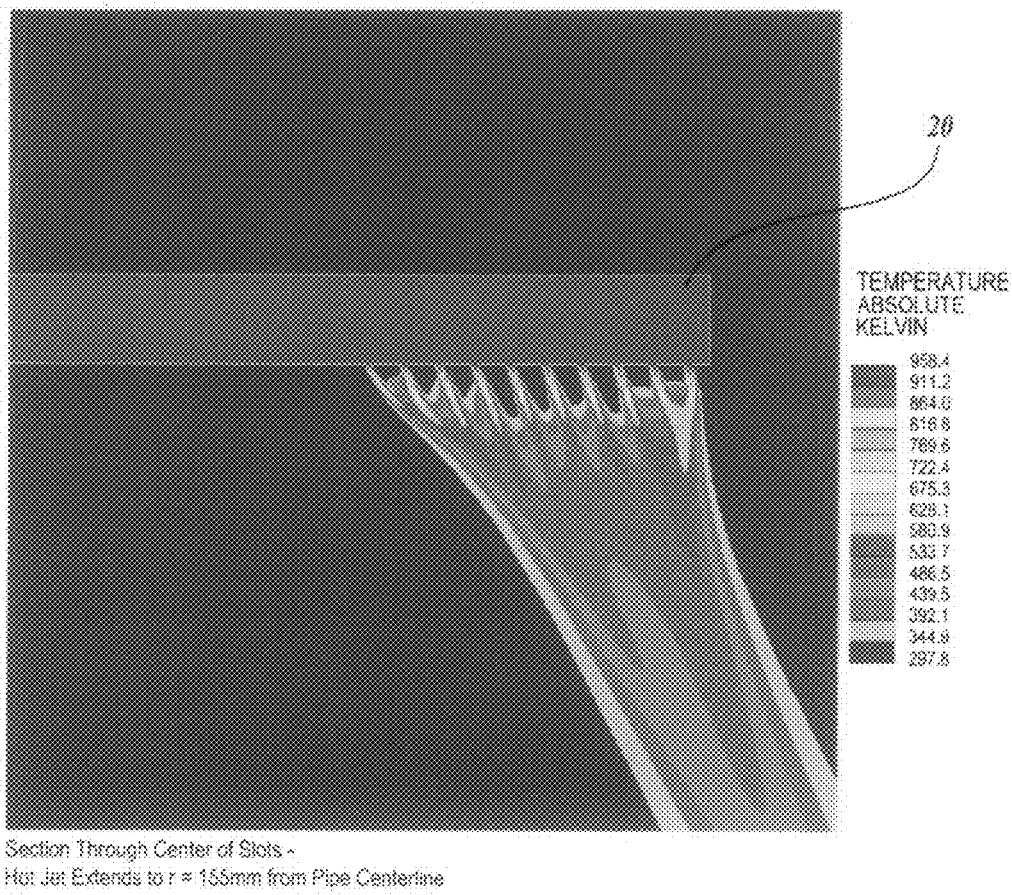
FIG. 6-9 are exit temperature section plots for the flow diffuser of FIGS. 1 and 2.

The simulated exhaust gas exit conditions seen in FIGS. 6-9 for the illustrated flow diffuser 20 of FIG. 2 will now be described in greater detail. FIG. 6 is a side, cross-section view taken through the center of the diffusion ports or slots 30, showing the exit temperature section plot of exhaust gas traveling through the flow diffuser 20 of FIG. 2. This section plot shows that hot exhaust gas travels through the exhaust pipe at about 940 degrees Kelvin. Heat from the exhaust gas begins to dissipate immediately upon exiting the slots 30. Such dissipation continues after exit, such that the exhaust gas temperatures drop to less than about 650 degrees Kelvin within a distance of 155 mm from the center longitudinal axis of the flow diffuser 20. (See also the line graph of FIG. 5, described in greater detail above).

Figure 7:
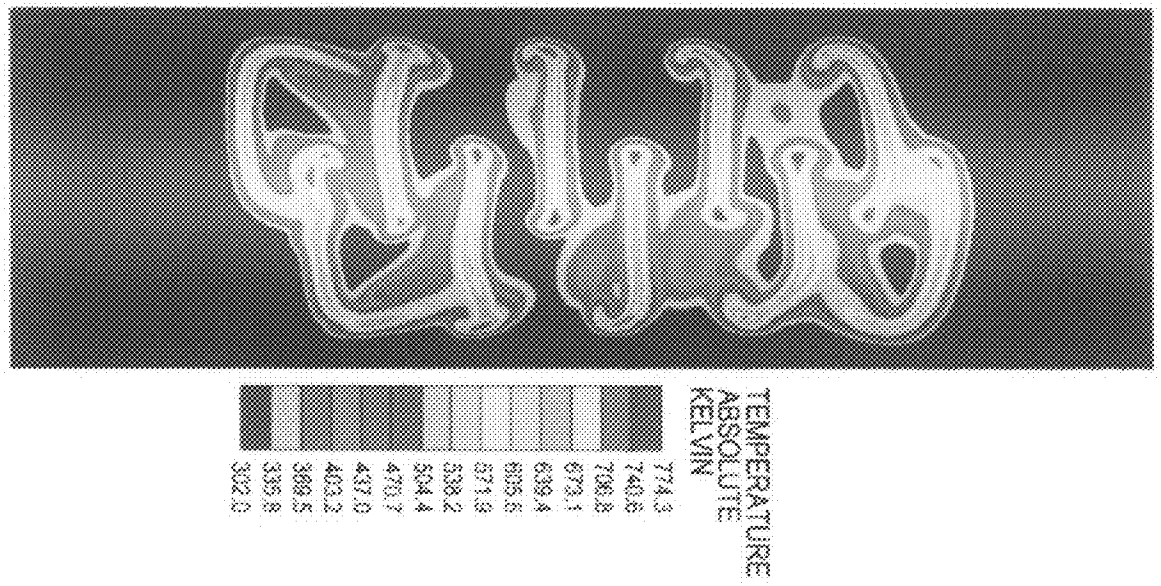
Figure 8:
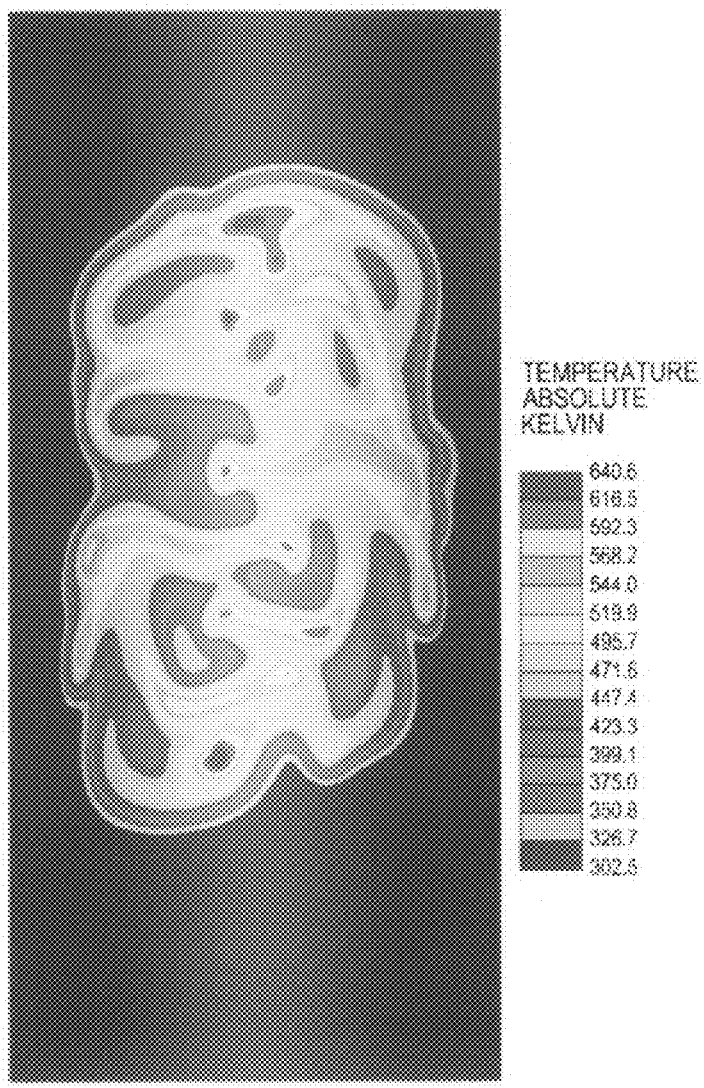
Figure 9:
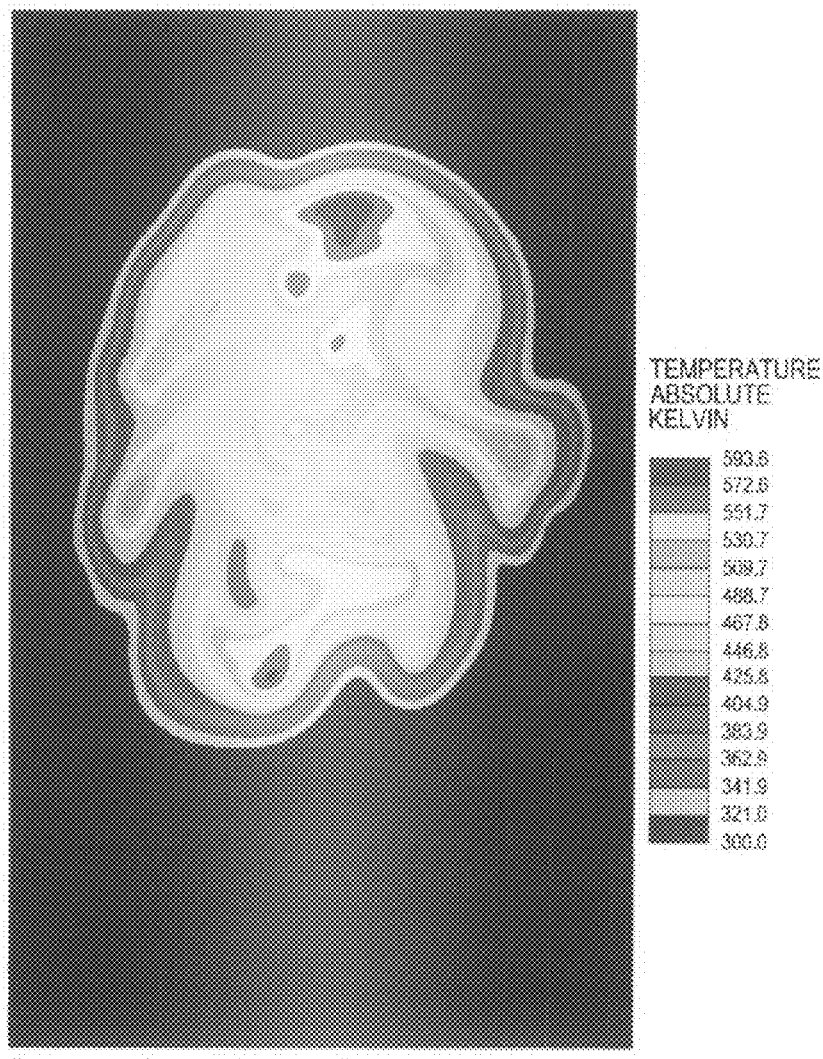

FIGS. 7-9 show temperature section plots at radial distances of 50 mm, 100 mm, and 150 mm, respectively, from the exhaust pipe outer surface at the diffusion ports 30 of the flow diffuser 20. These section plots show that the hottest cores of the exhaust gas streams diffuse from an exit temperature of 774.3 degrees Kelvin (FIG. 7) to 593.6 degrees Kelvin (FIG. 9) within a distance of 100 mm—between the 50 mm radial distance point (FIG. 7) to the 150 mm radial distance point (FIG. 9). In addition, by examining the expanding and cooling cores of the exhaust gas streams in the series of exit temperature section plots starting at FIG. 7 and ending at FIG. 9, these section plots indicate that enhanced mixing between the exhaust gas and the surrounding ambient air is occurring, as a result of the spacing and design of the slots 30, to significantly reduce the temperature of the exhaust gas.

EXAMPLE 2

Exhaust Temperature Section Plots for Flow Diffuser

Figure 10:
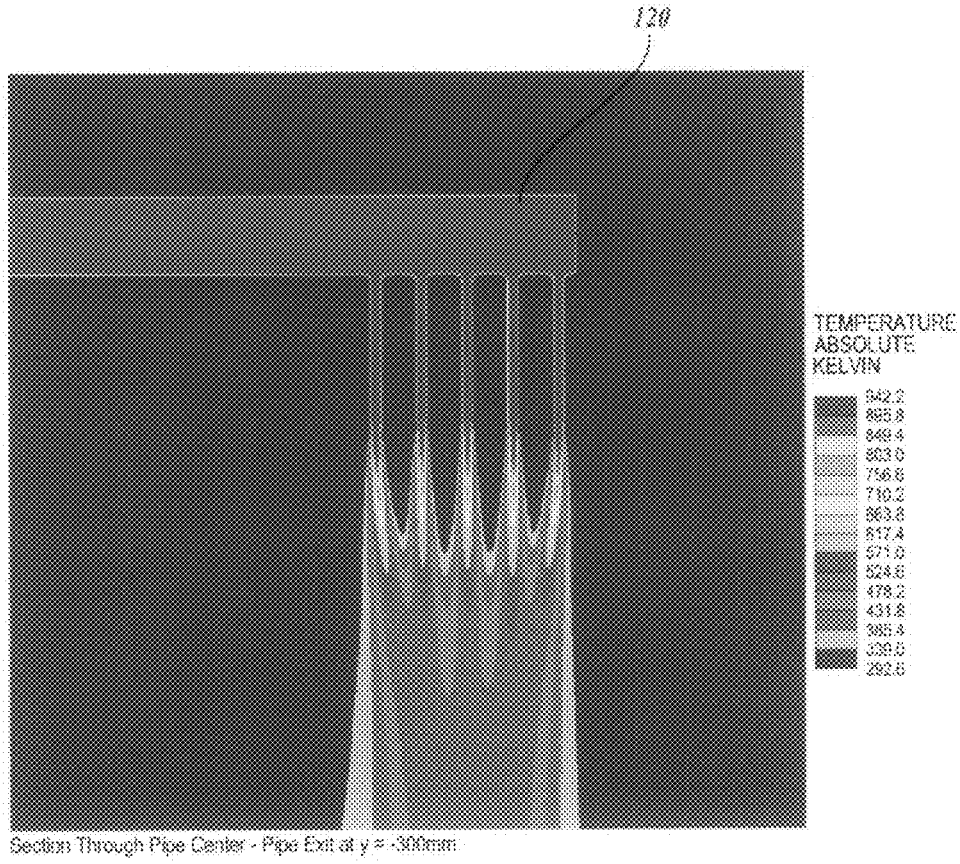
FIGS. 10-13 are exit temperature section plots for the flow diffuser of FIG. 3.

The simulated exhaust gas exit conditions seen in FIGS. 10-13 of the illustrated flow diffuser 120 of FIG. 3 will now be described in greater detail. FIG. 10 is a side view exit temperature section plot of the flow diffuser 120 of FIG. 3. This section plot shows that hot exhaust gas travels through the exhaust pipe at about 940 degrees Kelvin. Heat from the exhaust gas begins to dissipate immediately upon exiting the exit ports 134. Such dissipation continues after exit, such that the exhaust gas temperatures drop to less than 600 degrees Kelvin within a distance of 300 mm of the exit ports 134. (See also the line graph of FIG. 5, described in greater detail above).

Figure 11:
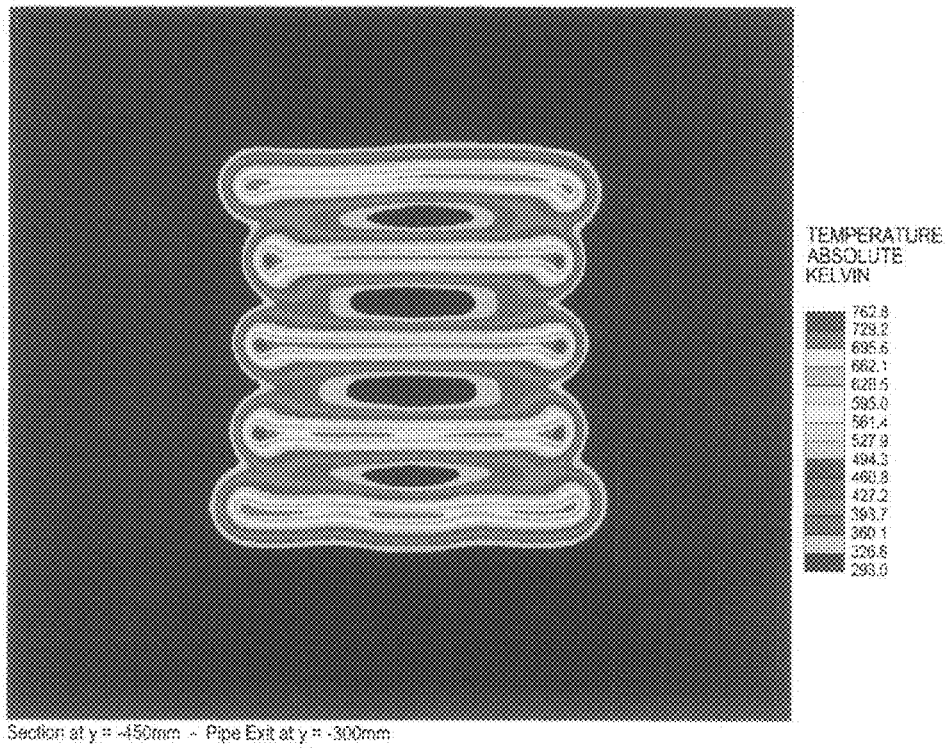

FIGS. 11-13 show temperature section plots at lateral distances of 150 mm, 300 mm, and 450 mm, respectively, from the exit plane at the exit ports 134 of the flow diffuser 120. These section plots show that the hottest cores of the exhaust gas streams diffuse from an exit temperature of 762.8 degrees Kelvin (FIG. 11) to 552.4 degrees Kelvin (FIG. 13) within a distance of 300 mm—between the 150 mm lateral distance point (FIG. 11) to the 450 mm lateral distance point (FIG. 13). In addition, by examining the expanding and cooling cores of the exhaust gas streams in the series of exit temperature section plots starting at FIG. 11 and ending at FIG. 13, these section plots indicate that mixing between the exhaust gas and the surrounding ambient air is occurring to reduce the temperature of the exhaust gas.

EXAMPLE 3

Exhaust Temperature Section Plots For Standard Exhaust Pipe

To illustrate the improved fluid mixing achieved with the flow diffusers 20 and 120 as compared to a standard exhaust pipe, FIGS. 14 and 15 are exit temperature section plots for an exhaust pipe taken from a lateral cross-section of the exhaust gas after exiting the device at lateral distances of 150 mm and 300 mm, respectively, from the exit plane of the exhaust pipe. Under the same conditions as the flow diffusers 20 and 120 were subjected to above with reference to EXAMPLES 1 and 2 and FIGS. 6-13, hot exhaust gas flows through the exhaust pipe at about 940 degrees Kelvin. These section plots show that the hottest core of the exhaust gas diffuses from 922.1 degrees Kelvin (FIG. 14) to only 920.9 degrees Kelvin (FIG. 15) within a distance of 150 mm—between the 150 mm lateral distance point (FIG. 14) and the 300 mm lateral distance point (FIG. 15).

By examining the limited expansion and mixing of the hottest core of the exhaust gas stream in the series of exit temperature section plots starting at FIG. 14 and ending at FIG. 15, these section plots indicate that significantly less mixing between the exhaust gas and the surrounding ambient air at the barrier is occurring, as compared to the mixing achieved with the flow diffusers 20 and 120, described above. Less mixing at the standard exhaust pipe outlet is a result of the constant velocity of the exhaust gas at the exhaust pipe inlet and outlet, as well as the shape factor for a standard exhaust pipe having a circular cross-section. Although the cross-sectional diameter of the hot spot decreases in diameter with lateral distance from the exit port, the hot spot remains a penetrating jet of hot exhaust gas, even after traveling a lateral distance of 300 mm from the exit port.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A flow diffuser for vehicles of the type having an engine and an exhaust pipe, the flow diffuser comprising:

(a) a substantially tubular body having an outer surface and a first end configured for attachment to an exhaust pipe; and (b) a diffusion portion in gaseous communication with the tubular body and including a plurality of channels extending outward from the outer surface of the tubular body, each channel having a root end located near the outer surface, an exit port, and a channel axis extending between the root end and the exit port, each of the plurality of channels increasing in flow area along the channel axis to reduce exhaust gas velocity, wherein the diffusion portion includes fluid passageways for the passage of surrounding air between adjacent channels and wherein each exit port has a shape factor of less than about 0.7;

wherein the shape factor is defined by a cross-section of the channel transverse to the channel axis according to the formula $4\pi$*area/(perimeter)$^2$, wherein in the formula area is the cross-sectional area of the channel at the exit port and perimeter is the cross-sectional perimeter length of the channel at the exit port.

2. The flow diffuser of claim 1, wherein each of the plurality of channels has an average width at the exit port, and wherein the fluid passageways between adjacent channels are at least as wide as the average width of adjacent channels at the exit ports.

3. The flow diffuser of claim 1, wherein each of the plurality of channels has an average width at the exit port, and wherein the fluid passageways between adjacent channels are at least as twice as wide as the average width of adjacent channels at the exit ports.

4. The flow diffuser of claim 1, wherein each of the plurality of channels has an average width at the exit port, and wherein the fluid passageways between adjacent channels are at least three times as wide as the average width of adjacent channels at the exit ports.

5. A flow diffuser for vehicles of the type having an engine and an exhaust pipe, the flow diffuser comprising:

(a) a substantially tubular body having an outer surface and a first end configured for attachment to an exhaust pipe;

(b) a diffusion portion on the outer surface having an elongated slot; and (c) at least one substantially serpentine channel extending outward from the elongated slot, the channel having a root end located near the elongated slot, an exit port, and a channel axis extending between the root end and the exit port, the channel increasing in flow area from the root end to the exit port along the channel axis to reduce exhaust gas velocity;

wherein the serpentine channel comprises a plurality of turns in a folded pattern along the channel axis such that the serpentine channel extends in a longitudinal direction in relation to the tubular body.

6. The flow diffuser of claim 5, wherein the plurality of turns comprises a plurality of peaks and troughs.

7. The flow diffuser of claim 6, wherein the at least one substantially serpentine channel includes fluid passageways for the passage of surrounding air between the adjacent peaks and adjacent troughs.

8. The flow diffuser of claim 6, wherein the plurality of peaks and troughs are substantially U-shaped or V-shaped in cross-section.

9. The flow diffuser of claim 7, wherein the substantially serpentine channel includes undulating first and second surfaces spaced from one another to define an average channel width at the exit port, and wherein the fluid passageways for the passage of surrounding air between the adjacent peaks and adjacent troughs are at least as wide as the average channel width at the exit port.

10. A flow diffuser for vehicles of the type having an engine and an exhaust pipe, the flow diffuser comprising:

(a) a substantially tubular body having an outer surface and a first end configured for attachment to an exhaust pipe; and (b) a diffusion portion in gaseous communication with the tubular body and including at least one channel extending outward from the outer surface of the tubular body, the at least one channel having a root end located near the outer surface, an exit port, and a channel axis extending between the root end and the exit port, the channel increasing in flow area along the channel axis to reduce exhaust gas velocity, wherein the at least one channel is an elongated, substantially serpentine channel comprising a plurality of turns in a folded pattern along the channel axis such that the serpentine channel extends in a longitudinal direction in relation to the tubular body.

11. The flow diffuser of claim 10, wherein the diffusion portion includes a plurality of channels.

12. The flow diffuser of claim 11, wherein the diffusion portion includes fluid passageways for the passage of surrounding air between adjacent channels.

13. The flow diffuser of claim 10, wherein the exit port has first and second surfaces spaced from one another to define an average channel width at the exit port.

* * * * *